US008616143B2

(12) United States Patent
Hancock, Jr. et al.

(10) Patent No.: US 8,616,143 B2
(45) Date of Patent: Dec. 31, 2013

(54) BOAT ACCESS HATCH AND SEAT

(75) Inventors: Thomas Douglas Hancock, Jr., Isle of Palms, SC (US); Dale Leslie Martin, North Charleston, SC (US)

(73) Assignee: Sportsman Boats Manufacturing, Inc., Summerville, SC (US)

( * ) Notice: Subject to any disclaimer, the term of this patent is extended or adjusted under 35 U.S.C. 154(b) by 0 days.

(21) Appl. No.: 13/483,550

(22) Filed: May 30, 2012

(65) Prior Publication Data

US 2013/0319313 A1 Dec. 5, 2013

(51) Int. Cl.
*B63B 17/00* (2006.01)

(52) U.S. Cl.
USPC ..... 114/363; 114/201 R

(58) Field of Classification Search
USPC ..... 114/363, 201 R
See application file for complete search history.

(56) References Cited

U.S. PATENT DOCUMENTS

| | | | | |
|---|---|---|---|---|
| 1,434,924 | A | 10/1922 | Beebee | |
| 4,811,680 | A | 3/1989 | Genth | |
| 5,076,188 | A | 12/1991 | Burroughs | |
| 5,497,724 | A | 3/1996 | Brown et al. | |
| 6,419,313 | B1 | 7/2002 | Newman | |
| 6,681,713 | B2 * | 1/2004 | Scott et al. | 114/361 |
| 6,715,440 | B2 * | 4/2004 | Biedenweg et al. | 114/363 |
| 6,722,732 | B1 * | 4/2004 | Menne | 297/129 |
| 6,837,173 | B2 | 1/2005 | Eck et al. | |
| 6,935,266 | B2 | 8/2005 | Hahn et al. | |
| 6,945,190 | B1 * | 9/2005 | Frandsen | 114/363 |
| 7,255,058 | B2 | 8/2007 | Forbes et al. | |
| 2005/0235901 | A1 * | 10/2005 | Blaisdell et al. | 114/361 |
| 2008/0066672 | A1 * | 3/2008 | Eekhoff et al. | 114/363 |
| 2008/0196649 | A1 | 8/2008 | Kalil | |

* cited by examiner

*Primary Examiner* — Edwin Swinehart
(74) *Attorney, Agent, or Firm* — Thomas L. Moses; Southeast IP Group, LLC

(57) ABSTRACT

A boat access hatch and compartment are provided, wherein the hatch cover also serves as a seat for the boat, and includes a three-dimensional, multi-planar configuration. In one embodiment, the hatch cover includes three panels. A generally vertically oriented backrest panel is attached to a rear side of a horizontal seating panel. A front vertical panel is attached to an opposed end of the seating panel. In a preferred embodiment, the three-panel hatch cover is integrally formed into a monolithic, single unit that includes a hinge at or near an upper rear portion of the backrest panel. Seat cushions may be provided on the seat panel and the backrest panel.

9 Claims, 3 Drawing Sheets

BOAT ACCESS HATCH AND SEAT

BACKGROUND OF THE INVENTION

The present invention relates generally to boat hatches that provide access to various types of compartments within the boat. More specifically, the present invention relates to boat hatches that provide access to engine compartments, storage compartments, or other compartments that house mechanical and electrical components that may need occasional maintenance and replacement. It should be understood, however, that the instant boat hatch may be used for any situation where it is advantageous to provide a large opening to a boat compartment, particularly in combination with seating.

Currently, there are many boats on the market that include compartments having a hatch that provides access to the compartment. Generally, the openings for these compartments are configured in a single plane, so that a flat hatch covers the opening to the compartment. These flat hatches typically include a latching or locking mechanism that allows the hatch to be closed and secured in the closed position while the boat is under way, in order to prevent water from entering the compartment and to prevent the items stored our housed in the compartment from bouncing out due to rough seas or wind. It is not uncommon for boats to include storage compartments beneath seating areas on the boat, so that a user may simply lift up the horizontally disposed seating cushion in order to gain access to a compartment therebelow.

For instance, U.S. Patent Application Pub. No. 2008/01966649 is directed to a hatch assembly for a boat including a base pivotally attached to a boat deck, whereby the base can pivot between an open position and closed position to provide access to a power source within a boat hull. The base defines a storage bin with a compartment for storage. A lid pivotally attaches to the base, whereby the lid can pivot from an open position to a closed position to provide access to the storage bin. A seat attaches to the lid and is supported by the base. A backrest pivotally attaches to the base and pivots between a sitting position and a reclining position.

U.S. Pat. No. 6,935,266 discloses a boat having an inboard/outboard drive unit including an engine covered by a hood. The hood is movable between an open position and a closed position. Seats are positioned on opposite sides of the hood. The seats are carried with the hood as the hood is moved between the open and closed positions. Seats that are moveable to enhance access to the stern are also disclosed.

U.S. Pat. No. 6,837,173 describes a watercraft with a powered hull and deck, which includes a forward passenger area and a rearward passenger area connected by a passageway. An engine is positioned within the hull behind the rearward passenger area. An engine cover covers the engine and at least one compartment adjacent to the engine. The compartment is separated from the engine by a removable wall. The compartment houses at least a portion of a canopy system that may be erected over at least a portion of the rearward passenger area of the boat. The watercraft includes a rear bench that conceals a storage bucket thereunder.

U.S. Pat. No. 5,076,188 is directed to a cover for a hatch including a rigid main body member and a seating member secured to the main body member. The seating member is an expanded polyethylene foam, and it extends across the hatch and engages the portion of the structural member of deck adjacent the hatch. The sealing member seals the hatch and insulates the compartment below the hatch. It acts as a gasket seal for the cover, and provides sound dampening and corrosion protection.

U.S. Pat. No. 4,811,680 discloses a deck hatch assembly for marine craft formed in the upper deck surface of the craft on the port and starboard sides. A submerged surface is integrally formed in the upper deck surface, being provided with a hatch opening surrounded by a raised peripheral ridge. The raised ridge, together with the submerged surface and the upper deck surface, forms a drain channel for directing water away from the stern of the craft. A pivotably mounted hatch cover is provided for normally sealing and closing off the hatch opening. The hatch cover may be raised upwardly from the bulkhead of the marine craft toward the stern for the purpose of providing ventilation to below deck compartments and for allowing access to the upper deck surface from below deck areas. A pair of gas spring assemblies is provided for positively and automatically retaining the hatch cover in the closed, or any one of a number of open positions. The hatch cover, in the closed position, is completely flush with the upper deck surface and is adapted to conform to the configuration of any deck, including styling lines thereof.

Oftentimes, these compartments include electrical or mechanical components of the boat. For instance, boats may have a stern compartment that houses water filters, electrical lines, fuel tanks, batteries, and other items that occasionally require maintenance or replacement. The typical boat access hatch includes an opening in a single plane, which is usually oriented in a horizontal or vertical configuration. In order to gain access to these compartments, the hatch opened and swings outwardly away from the opening. If work is to be performed within the compartment, then the worker must either bend down and through the hatch (if the hatch is vertically oriented), or must orient himself so that his upper torso is oriented downwardly into the hatch (if the hatch is horizontally oriented). Either way, it is difficult for a person to orient himself into a comfortable position in order to work on components that are located within the compartment.

Thus, it would be desirable to provide a boat access hatch and compartment with a large, multi-planar opening to allow a person easier access to the compartment and items stored or installed therein. Further, it would be desirable to provide a boat access hatch and compartment opening that conforms to the shape of a seat, so that the hatch cover may also serve as a seat within the boat. Such a hatch and compartment would also allow for the storage of larger or bulky items that may be difficult to squeeze through a standard, flat planar opening.

BRIEF SUMMARY OF THE INVENTION

In accordance with one aspect of the invention, a boat access hatch and compartment are provided, wherein the hatch cover also serves as a seat for the boat, and includes a three-dimensional, multi-planar configuration. In one embodiment, the hatch cover includes three panels. A generally vertically oriented backrest panel is attached to a rear side of a horizontal seating panel. A front vertical panel is attached to an opposed end of the seating panel. In a preferred embodiment, the three-panel hatch cover is integrally formed into a monolithic, single unit that includes a hinge at or near an upper rear portion of the backrest panel. Seat cushions may be provided on the seat panel and the backrest panel.

The opening of the compartment is configured to match the shape of the hatch cover, and a rubber gasket may be used as a seal around the opening, in order to prevent water from seeping through the hatch when it is in a closed position. A latch may be employed, preferably near a bottom portion of the front vertical panel, in order to secure and maintain the hatch cover in a closed position. A gas piston, or a pair of gas spring pistons may be used to facilitate opening of the hatch, and to maintain the hatch in an open position. In use, the three-panel hatch may be lifted upwardly so that the hatch cover pivots about the hinges, allowing access to the large hatch opening to the compartment.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
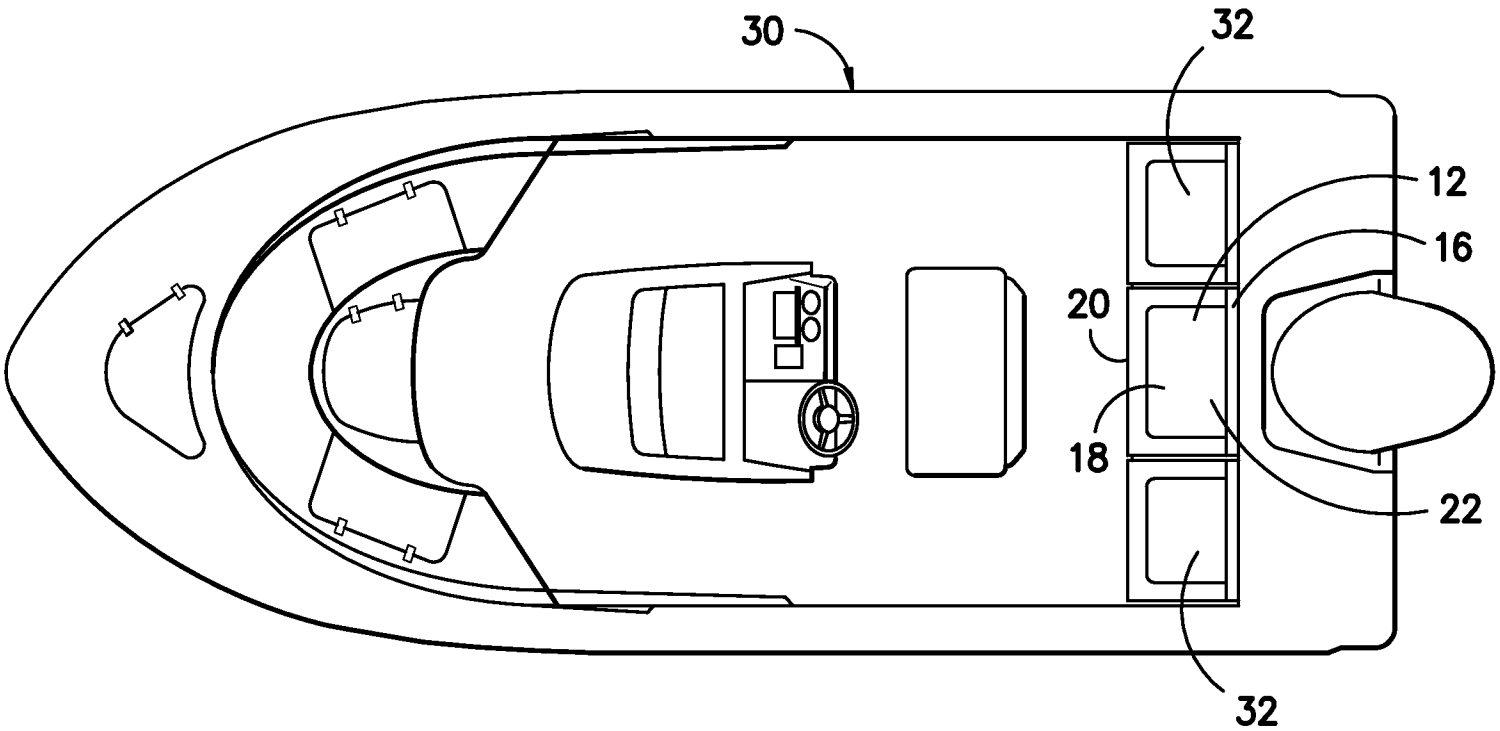
FIG. 1 is a top view of a boat having a multi-planar boat access hatch and cover in accordance with one aspect of the present invention, wherein the hatch cover is in the closed position.
Figure 2:
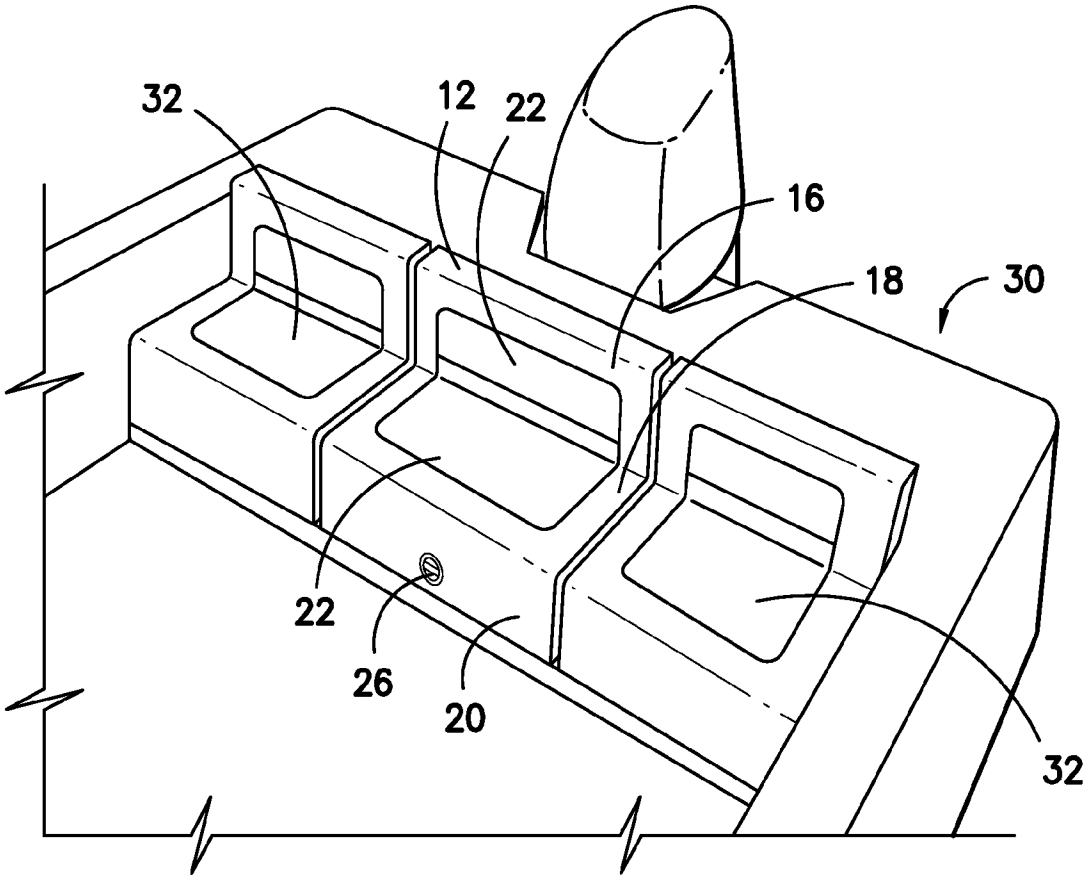
FIG. 2 is a perspective view of one embodiment of a multi-planar boat access hatch and hatch cover in accordance with one aspect of the present invention, wherein the hatch cover is in the closed position.
Figure 3:
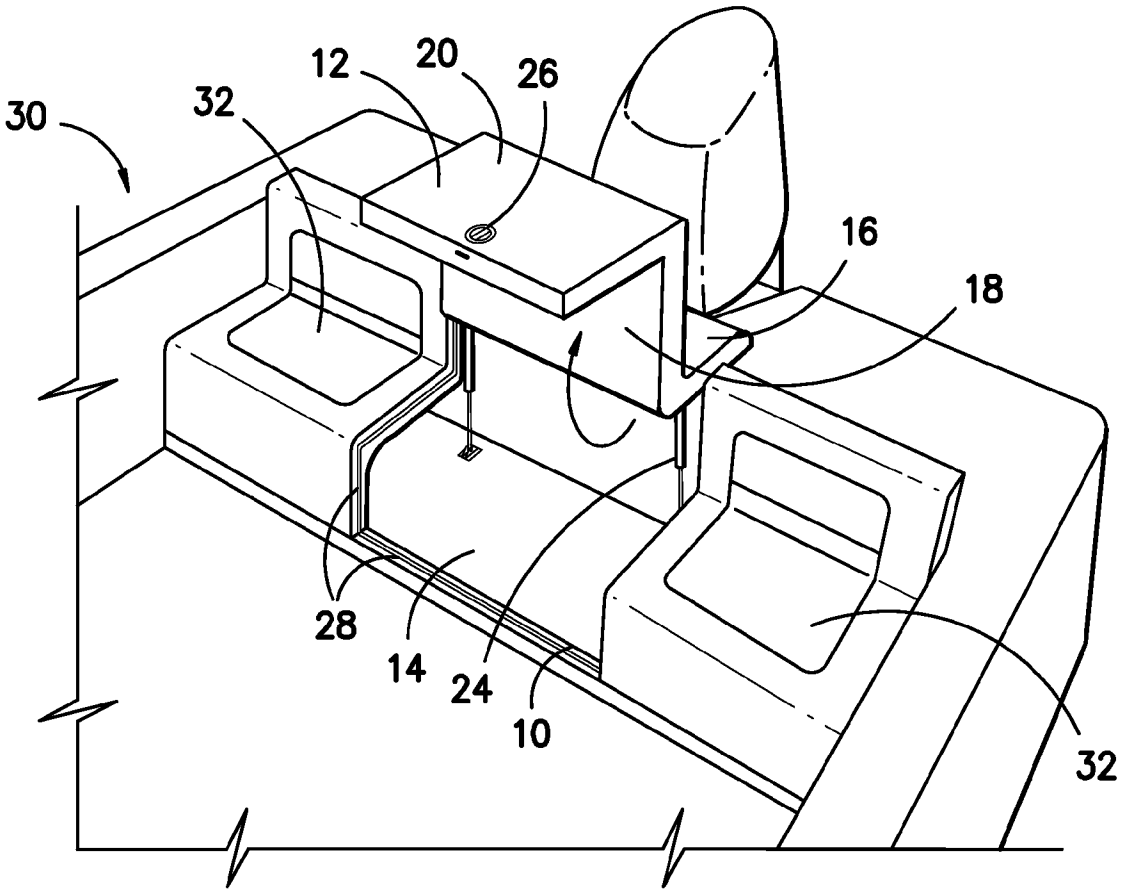
FIG. 3 is a perspective view of one embodiment of a multi-planar boat access hatch cover in accordance with one aspect of the present invention, wherein the hatch cover is in the open position.

The present invention includes, in a first embodiment, a multi-planar boat access hatch 10 and hatch cover 12, wherein the hatch cover 12 also serves as a seat, as shown in FIGS. 1-3. In a preferred embodiment, the boat access hatch 10 and compartment 14 is positioned in the aft portion of the boat 30, adjacent the stern, although it should be understood that the hatch 10 and compartment 14 could be located in any desired location. In order to provide easy access to the compartment 14 and provide for additional seating in the boat 30, the hatch cover 12 is configured in the general shape of a seat in a tri-planar configuration. The hatch cover 12, in a preferred embodiment, includes three panels. A generally vertical backrest panel 16 is attached to the rear edge of a generally horizontal seat panel 18. A generally vertical front panel 20 extends downwardly from the front edge of the seat panel 18. Seat cushions 22 may be attached to the outer sides of the seat panel 18 and the backrest panel 16. In a preferred embodiment, the three panels of the hatch cover 12 are integrally formed into a monolithic, single unit.

Hinges may be attached to the upper portion of the underside of the backrest panel 16 and the rim of the hatch 10 opening, so that the bottom portion of the front panel 20 may be lifted upwardly, allowing the hatch cover 12 to pivot about the hinge and provide access to the compartment 14 below. Optionally, a pair of gas spring pistons 24 may be used to facilitate the opening of the hatch cover 12, and for maintaining the hatch cover 12 in an open position. Preferably, a latch 26 is located on a lower portion of the front panel 20, in order to secure and maintain the hatch cover 12 in a closed position, when desired. A rubber gasket 28 may be positioned around the opening of the hatch 10, so that the hatch cover 12 comes into contact and seals with the gasket 28 when the hatch cover 12 is in a closed position, thus preventing water from seeping into the compartment 14 and possibly causing corrosion. It is also contemplated that the hatch cover 12 may be removable from the hatch 10 instead of being attached with hinges.

Optionally, the hatch 10 opening may include a recessed groove around a periphery thereof, and the hatch cover 12 may include a corresponding lip on an underside thereof, so that the lip fits into the recessed groove, as an added measure to prevent water from seeping into the compartment 14. Additionally, the hatch 10 may be positioned between a pair of seats 32, particularly when the hatch 10 is located adjacent the stern, so that when the hatch cover 12 is in the closed position, the seat and seat cushions 22 on top of the hatch cover are in alignment, or flush, with the seats 32 on either side thereof, thus forming a type of bench seat. It is further contemplated that the compartment 14 may extend beneath the seats 32 on either side of the hatch 10 opening, so that large items may be stored therein. The hatch cover 12, compartment 14 and assembly may be made from any suitable material, including fiberglass, plastic or metal, or any combination thereof. The seat cushions 22 may be permanently attached to the hatch cover 12, or may be removable. It is also contemplated that a light bulb or fixture may be positioned on an underside of the hatch cover 12, in order to illuminate the compartment 14, when desired.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A boat hatch comprising:

a fixed, enclosed storage compartment having a tri-planar opening with a periphery around said opening;

an integrally formed, tri-planar hatch cover pivotally attached to said periphery of said opening, wherein said hatch cover is shaped to correspond to said tri-planar opening so that said hatch cover may be disposed either in an open position or a closed position;

said hatch cover comprising a generally vertical backrest panel attached to a rear edge of a generally horizontal seat panel, and a generally vertical front panel extending downwardly from a front edge of said seat panel; and wherein said tri-planar hatch cover provides access to said fixed, enclosed storage compartment when said tri-planar hatch cover is in an open position.

2. The boat hatch set forth in claim 1, further including seat cushions attached to an outer surface of said generally vertical backrest panel and said generally horizontal seat panel.

3. The boat hatch set forth in claim 1, further comprising a latch positioned on said generally vertical front panel for securing and maintaining said hatch cover in a closed position.

4. The boat hatch set forth in claim 1, further including a gasket positioned around said periphery of said hatch opening.

5. The boat hatch set forth in claim 1, wherein said hatch cover is attached to said periphery of said opening with a hinge, and wherein said hinge is positioned on an upper portion of an underside of said generally vertical backrest panel.

6. The boat hatch set forth in claim 1, further including at least one gas spring piston connected between said hatch cover and said compartment adjacent a periphery of said opening.

7. The boat hatch set forth in claim 1, wherein said hatch cover is integrally formed so that said generally vertical backrest panel and said generally horizontal seat panel and said generally vertical front panel are formed of a single, monolithic construction.

8. The boat hatch set forth in claim 1, further including a light fixture attached to an underside of said hatch cover for illuminating said compartment.

9. The boat hatch set forth in claim 2, wherein said opening is positioned between a pair of seats, so that when said hatch cover is in the closed position, a bench seat is formed between the seat cushions disposed on the hatch cover and the pair of seats on either side thereof.

* * * * *